US005779570A

United States Patent [19]

Bear

[11] Patent Number: 5,779,570

[45] Date of Patent: Jul. 14, 1998

[54] STUFFED ANIMAL WITH REMOVABLE BASKET FOR A BALL GAME

[75] Inventor: Hillard Bear, Beverly Hills, Calif.

[73] Assignee: KKH Corp., Culver City, Calif.

[21] Appl. No.: 795,465

[22] Filed: Feb. 4, 1997

[51] Int. Cl.[6] ..... A63B 63/08

[52] U.S. Cl. ..... 473/481; 273/401; 273/402; 446/369

[58] Field of Search ..... 473/481; 273/400, 273/401, 402; 446/369

[56] References Cited

U.S. PATENT DOCUMENTS

| | | | |
|---|---|---|---|
| D. 369,053 | 4/1996 | Keller | D6/598 |
| D. 369,935 | 5/1996 | Keller | D6/598 |
| D. 372,392 | 8/1996 | Bala | D6/598 |
| 2,939,707 | 6/1960 | Lemelson | 273/402 |
| 5,326,300 | 7/1994 | Sonders | 446/369 X |
| 5,601,469 | 2/1997 | Yane | 446/369 X |

*Primary Examiner*—William H. Gried
*Attorney, Agent, or Firm*—Beehler & Pavitt

[57] ABSTRACT

A stuffed figure having a torso with a lower seating end and an upper shouldered end with a pair of forwardly projecting appendages between which may be secured either removably or permanently, a receptacle adapted to receive an object, such as a ball. The receptacle may be an open or closed bottom and the torso may be provided with means on its back to hang the figure from a hook at a predetermined level.

3 Claims, 1 Drawing Sheet

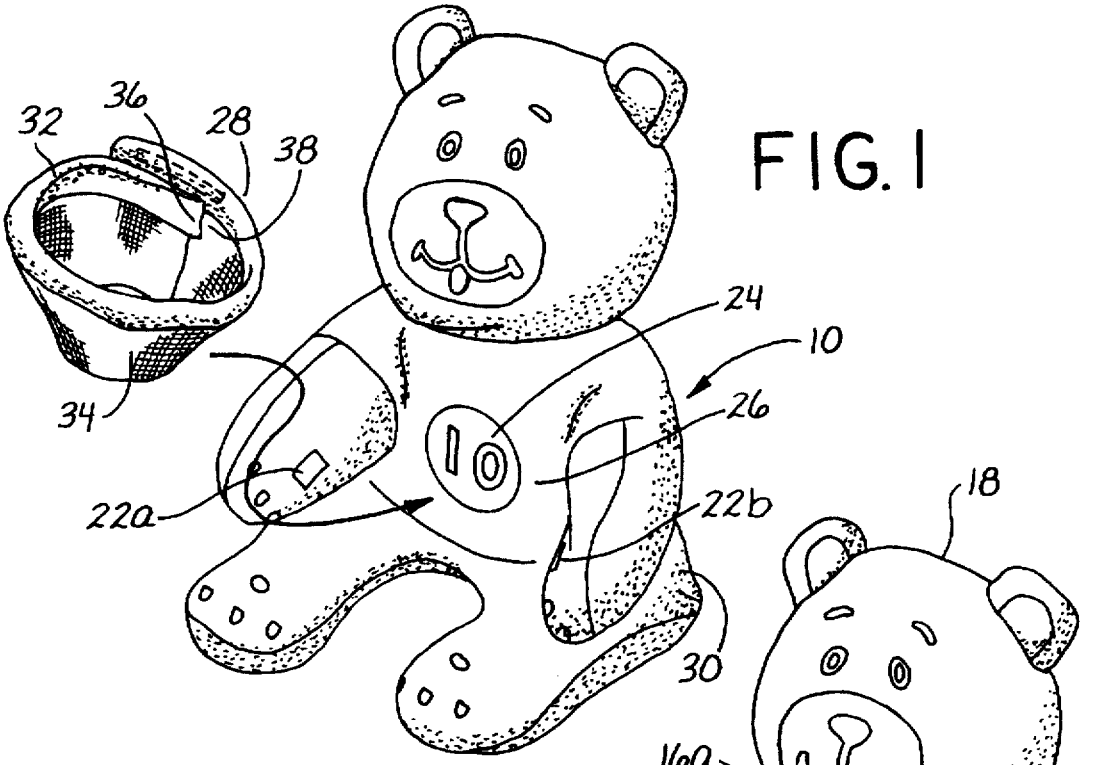
FIG. 1
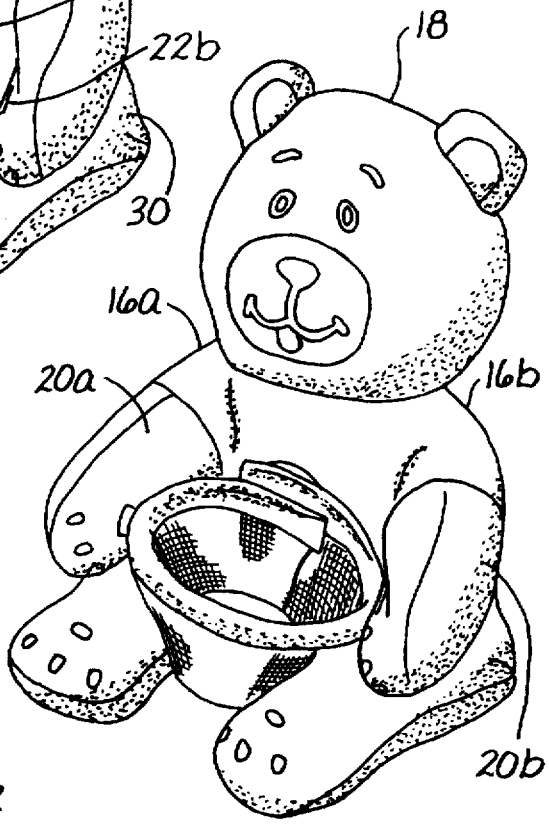
FIG. 2
FIG. 3
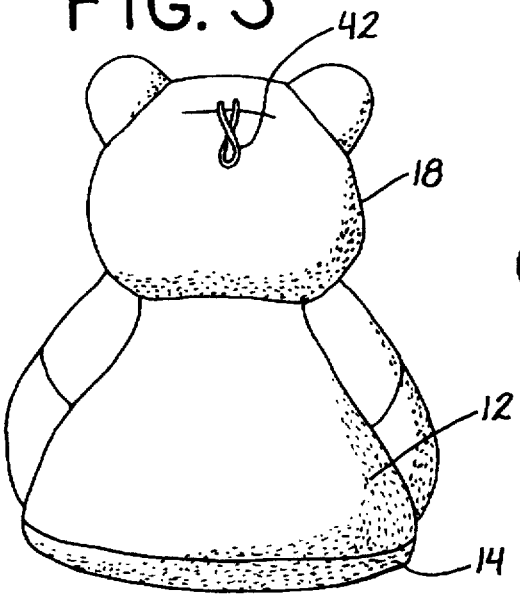

STUFFED ANIMAL WITH REMOVABLE BASKET FOR A BALL GAME

FIELD OF THE INVENTION

This invention relates generally to the field of stuffed animals, and, in particular, to such an animal which may be utilized by a small child for playing a ball game as well as for a comfort companion.

BACKGROUND OF THE INVENTION

While "teddy bears" and other animal toys and dolls for children have been fabricated for centuries, it has only been in recent years that pillows and folding seats of soft material have been designed and marketed for children in animal forms such as are found in U.S. Design Pat. Nos. Des. 369,053, Des. 369,935 and Des. 372,392. Such pillows and folding seats have recently become quite popular among small children, particularly where they are fabricated in some shape which is recognizable by the child, ss for example, a bear, a dog, an alligator, a fish, etc. While these soft animal figures may provide comfort to the child when he is napping, or may serve in some cases in the nature of a "security blanket," some children may tend not to be so dependent upon any stuffed figure, and may only use it, if at all, at only napping or other sleeping times, or in the case of a folding seat cushion, either in a car or to watch television.

Since these stuffed figures are not inexpensive, it would be desirable to have them perform some other function than simply that of a pillow or a cushion seat. Also, it is always desirable to have some kind of toy or other object which can be employed to provide interaction between a parent, or older sibling, and a child.

In addition, with the ever increasing popularity of certain ball games, such as basketball, some parents may desire to teach children at an early age to participate in and develop some early skill in one or more selected ball games. Stuffed animals or other stuffed figures have not heretofore been adapted to perform any of these last mentioned functions.

SUMMARY OF THE INVENTION

The present invention comprises a stuffed figure having a body with a torso capped by a pair of shoulders from which forwardly project a pair of arms. The body may be in a configuration of a bear and the base of the torso supported for resting on a floor as by legs or a large rump. In one form of the invention, means are provided at the back of the torso to hang the body from a hook or peg at a predetermined level above a floor. A receptacle, such as a basket or hoop, may be disposed between the arms of, and supported against the torso. This basket may be permanently attached to the arms and the torso, or it may be removable therefrom. In the latter case, the basket or hoop and the arms and/or torso may be provided with snaps, or preferably, interlocking VELCRO strips. The basket or hoop may either have an open bottom through which a ball may be passed, or it could be closed to retain any ball or other object tossed or dropped into it.

Desirably, the figure may be stuffed with soft material, so that when not being used in a game, upon removal of the hoop or basket, it may serve as a pillow or cushion for head or body support of a child.

DESCRIPTION OF THE DRAWINGS

In the accompanying drawings,

FIG. 1 is a perspective view of an embodiment of the invention in the form of a simulated bear figure taken from slightly-above the front of the left side of the bear and showing a receptacle insertable between the arms of the figure.

FIG. 2 is similar to FIG. 1, except that the receptacle is shown disposed between the arms of the figure and against its chest.

FIG. 3 is a rear view of the figure showing a loop by which the figure may be hung.

DESCRIPTION OF THE PREFERRED EMBODIMENT

Referring to FIG. 1, there is shown an embodiment of the invention in the form of a stuffed bear 10 having a torso 12, the lower end of which is merged into a seating portion 14. The upper portion of the torso 12 is capped by shoulders 16*a* and 16*b* on which is centrally supported a head 18. Extending forwardly of the torso from the shoulders 16*a* and 16*b*, respectively, are at pair of arms or appendages 20*a*, 20*b*. Each arm or appendage 20*a*, 20*b* may be provided with a VELCRO hook or loop patch 22*a*, 22*b*, respectively, and an additional such patch 24 may be provided in the center 26 of the torso 12.

The body 10 may be formed of an outer fabric (sometimes herein referred to as a skin) 30, which may be stuffed with kapok, cut up rags, or other soft yieldable material (not shown), so that the body 10, including its head 18 is yieldable and may serve as a child's pillow or cushion. The formation of bodies of this type is well-known in the art and, per se, forms no part of the present invention. Examples of such prior art bodies are shown in the design patents referred to above.

The receptacle 28 may be formed as a fixed basket (not shown), or in the manner illustrated in FIGS. 1 and 2. An elongated, flexible element 32 from which depends a netting 34 is bent around to join its ends 36 and 38, which may be provided with engaging VELCRO hook and loop strips (not shown) to enable the ends 36 and 38 to be removably secured together in the manner shown. In addition, VELCRO patches (not shown) are provided on the outer side of the flexible element 32 to engage complementary patches 22*a*, 22*b*, and 24, thereby enabling the thus-formed receptacle 28 not only to be formed as a circular basket, but, also, to be removably securable between the arms or appendages 20*a* and 20*b* of the figure 10 and against its chest 26. The receptacle 28 may be either closed at the bottom of the netting 34, or may be provided with an opening 40 through which a ball (not shown) when dropped or tossed into the receptacle 28, may pass down and out of the receptacle 28. Loop means 42 may be provided at the back of the head 18 to enable the figure 10 to be hung on a hook or peg extending from a wall or other vertical surface.

In use, the figure 10 may serve as a simple child's pillow or play toy, e.g., such as a simulated teddy bear. However, the figure 10 may be readily adapted for playing a ball game with a child by forming the receptacle 28 and securing it between the appendages 20*a*, 20*b* and against the chest 28 of the figure by the interlocking strips 22*a*, 22*b*, 26 engaging the element 32. If the child is quite small, the game may be simply one where the child attempts to pitch a ball (not shown) into the receptacle 28 through which it will pass and drop out. On the other hand, where the child may be older and is aware of basketball techniques, the figure 10 may be hung up on a vertical surface at a height that may require the child to reach or jump up and drop the ball into the receptacle 28 in the manner of a "slam dunk."

It may be seen, then, that the present invention enables a stuffed animal figure of the type which has heretofore only served as a pillow or some type of doll to be utilized for an interactive purpose with the child, either by himself or with his or her parent.

While the present invention as illustrated and described is shown in the form of a type of simulated bear, it will be obvious to those skilled in the art that the present invention could be adapted to a wide variety of figures, human or animal, which have appendages extending from a torso between which appendages a receptacle may be removably, or even permanently, secured in the manner herein taught.

I claim:

1. A game figure comprising a body, said body having a skin, said skin being stuffed with a yieldable material and said body being configured with a torso having a lower seating end and an upper end provided with a pair of shoulders from each of which shoulders forwardly projects an appendage; and a receptacle disposed and securable between the projecting appendages, said receptacle being configured to receive a ball when tossed into the receptacle; and said receptacle comprising a basket having an open bottom whereby the ball may pass down, through, and out of the receptacle.

2. A game figure comprising a body, said body having a skin, said skin being stuffed with a yieldable material and said body being configured with a torso having a lower seating end and an upper end provided with a pair of shoulders from each of which shoulders forwardly projects an appendage; and a receptacle disposed and securable between the projecting appendages, said receptacle being configured to receive a ball when tossed into the receptacle; and said receptacle is formed by an elongated, flexible rim element from which downwardly extends a netting, said element having first and second opposite ends, said element being bent in curved manner to join the first and second ends, and said element being removably secured to the appendages interlocking VELCRO patches.

3. A game figure comprising a body, said body having a skin, said skin being stuffed with a yieldable material and said body being configured with a torso having a lower seating end and an upper end provided with a pair of shoulders from each of which shoulders forwardly projects an appendage; and a receptacle disposed and securable between the projecting appendages, said receptacle being configured to receive a ball when tossed into the receptacle;

said receptacle comprising a basket having an open bottom whereby the ball may pass down, through, and out of the receptacle; and said receptacle is formed by an elongated, flexible rim element from which downwardly extends a netting, said element having first and second opposite ends, said element being bent in curved manner to join the first and second ends, and said element being removably secured to the appendages interlocking VELCRO patches.

* * * * *